US007549684B2

(12) United States Patent
Shi et al.

(10) Patent No.: US 7,549,684 B2
(45) Date of Patent: Jun. 23, 2009

(54) LATCH MECHANISM

(75) Inventors: Zheng Shi, Shenzhen (CN); Chien-Li Tsai, Tu-Cheng (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,666

(22) Filed: Sep. 8, 2006

(65) Prior Publication Data

US 2007/0075550 A1 Apr. 5, 2007

(30) Foreign Application Priority Data

Sep. 9, 2005 (CN) ..... 2005 2 0064406

(51) Int. Cl.
*E05C 9/10* (2006.01)

(52) U.S. Cl. ..... 292/37; 292/49; 292/65; 292/159; 292/165; 292/169.12; 292/169.14; 361/683

(58) Field of Classification Search ..... 292/37, 292/49 X, 46, 65 X, 111, 124, 98, 159 X, 292/165 X, 169, 169.12 X, 169.14, 32, 33, 292/42, 137, 163, 175, 146, 150, 30, 2, DIG. 11, 292/38, DIG. 63; 361/732, 742, 683
See application file for complete search history.

(56) References Cited

U.S. PATENT DOCUMENTS

| | | | | |
|---|---|---|---|---|
| 1,550,532 | A * | 8/1925 | French | 292/37 |
| 6,115,239 | A * | 9/2000 | Kim | 361/681 |
| 6,517,129 | B1 * | 2/2003 | Chien et al. | 292/251.5 |
| 6,565,133 | B1 * | 5/2003 | Timothy | 292/242 |
| 6,587,350 | B1 * | 7/2003 | Lin et al. | 361/754 |
| 6,659,516 | B2 * | 12/2003 | Wang et al. | 292/251.5 |
| 7,048,311 | B2 * | 5/2006 | Sawatani et al. | 292/33 |
| 7,164,578 | B2 * | 1/2007 | Wang et al. | 361/683 |

* cited by examiner

*Primary Examiner*—Patricia Engle
*Assistant Examiner*—Mark Williams
(74) *Attorney, Agent, or Firm*—Wei Te Chung

(57) ABSTRACT

A latch mechanism is provided to lock a cover unit to a base unit, which includes a latching member for being slidably installed in the cover unit and a button for being rotatably fixed to the cover unit. The latching member includes a main body and a hook extending from the main body for engaging with the base unit. The button includes a driving surface operatively engagable with the main body of the latching member for cooperatively transforming rotating movement of the button into linear movement of the latching member thereby disengaging the hook from the base unit.

4 Claims, 4 Drawing Sheets

LATCH MECHANISM

FIELD OF THE INVENTION

The present invention relates to a latch mechanism, and more particularly to a latch mechanism for a portable computer.

DESCRIPTION OF PRIOR ART

Typically, an electronic device, such as a portable computer, includes a cover unit and a base unit pivotally connected with the cover unit, and a latch mechanism is provided to lock the cover unit to the base unit.

As disclosed in U.S. Pat. No. 6,115,239, a latch mechanism for locking a cover unit to a base unit, includes a latch frame movably installed inside the cover unit, a plurality of latches are formed on the latch frame at predetermined intervals and one end portion of each latch protrudes from a front surface of the cover unit, and a slide knob is operatively connected to the latch frame for concurrently operating the latches. The latches are inserted into and locked by latch grooves formed at positions corresponding to the latches on an upper surface of the base unit. The latches are urged against the base unit by elastic forces applied by double springs mounted on two ends of the latch frame. However, to open the cover unit, the slide knob is slid to overcome the elastic forces of the springs to move the latch mechanism for disengaging from the base unit. The slide force depends on friction between the slide knob and fingers of an operator. It is laborious for an operator to provide enough force to move a slide knob.

What is needed, therefore, is a laborsaving latch mechanism.

SUMMARY OF THE INVENTION

An exemplary latch mechanism is provided for locking a cover unit to a base unit. The latch mechanism includes a latching member for being slidably installed in the cover unit and a button for being rotatably fixed to the cover unit. The latching member includes a main body and a hook extending from the main body for engaging with the base unit. The button includes a driving surface operatively engagable with the main body of the latching member for cooperatively transforming rotating movement of the button into linear movement of the latching member thereby disengaging the hook from the base unit.

Other advantages and novel features will become more apparent from the following detailed description of a preferred embodiment when taken in conjunction with the accompanying drawings, in which:

DETAILED DESCRIPTION OF THE INVENTION

Figure 1:
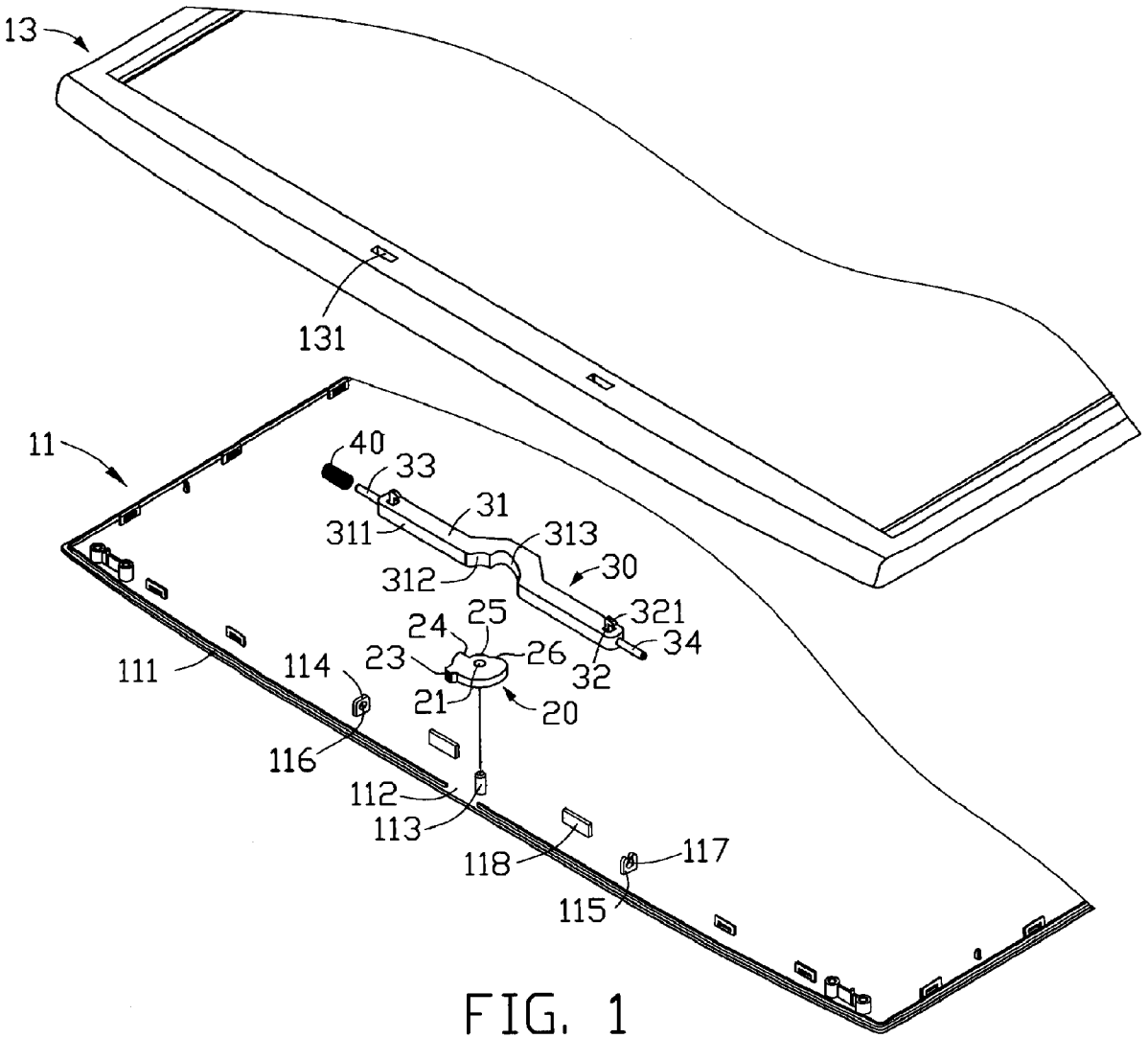
FIG. 1 is an exploded, isometric, inverted view of a latch mechanism with a cover unit in accordance with a preferred embodiment of the present invention, and the cover unit includes a first panel and a second panel.
Figure 4:
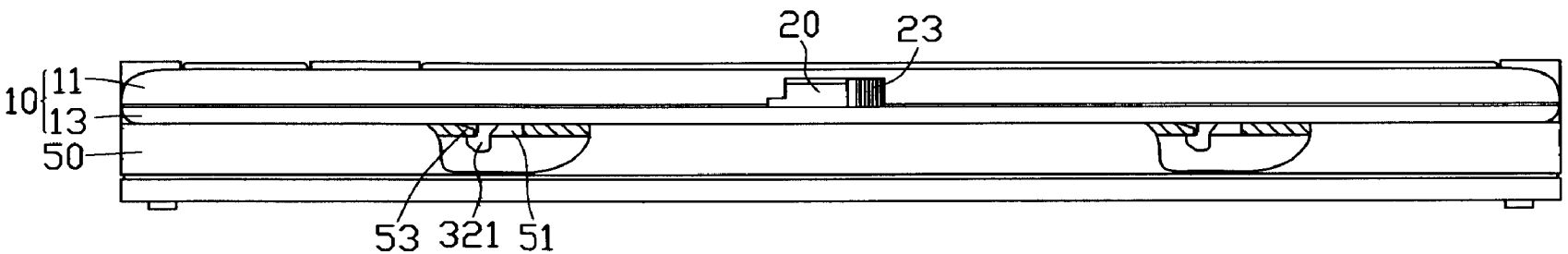
FIG. 4 is a schematic, assembled and partly-sectioned view of FIG. 1 with a base unit.

Referring to FIGS. 1 and 4, a latch mechanism is provided in accordance with a preferred embodiment of the present invention, for locking a cover unit 10 to a base unit 50 of an electronic device, such as a portable computer. The latch mechanism includes a button 20, a latching member 30, and an elastic member 40. In this embodiment, the elastic member 40 is a spring.

The cover unit 10 includes a first panel 11, and a second panel 13 having a pair of through holes 131 defined therein. The first panel 11 includes a front wall 111, and a recess 112 is defined inward in the middle of the front wall 111. A pivot 113 extends up from an inside surface of the first panel 11 at the rear of the recess 112. A first plate 114 and a second plate 115 are formed oppositely on the inside surface of the first panel 11 adjacent the front wall 111. A first guiding hole 116 is drilled in a generally middle portion of the first plate 114, and a second guiding hole 117 is defined in the second plate 115 by cutting out a top portion thereof. Two spaced guiding tabs 118 are disposed generally between the first and second plates 114, 115 in parallel to the front wall 111.

The button 20 is generally a circular plate with a portion cut out therefrom. A pivot hole 21 is defined through a center of the circular plate. A knob 23 extends from a circumferential surface of the circular plate. A planar blocking surface 24 is formed extending from the circumferential surface to but not reaching the pivot hole 21 of the button 20, and spaced from the knob 23. An arcuate mating surface 25 extends a predetermined length around the pivot hole 21 from an end of the blocking surface 24 adjacent the pivot hole 21. An arcuate driving surface 26 is defined with two ends thereof communicating with the mating surface 25 and the circumferential surface respectively. An acme of the mating surface 25 is nearer to the pivot hole 21 than an acme of the driving surface 26.

The latching member 30 includes a main body 31 with an arcuate middle portion offsetting a distance from a line defined by two opposite ends thereof. An arcuate concave section 312 is defined in the middle portion of the main body 31 communicating with a lateral surface 311 thereof, corresponding to the mating surface 25 of the button 20. An arcuate recessed section 313 is formed in the middle portion of the main body 31, and cooperatively forms a protruding edge with the concave section 312, corresponding to the driving surface 26 of the button 20. A pair of hooks 32 each having a hooking portion 321 protrude out from a top surface of the main body 31, corresponding to the through holes 131 of the second panel 13. A first rod 33 and a second rod 34 extend from the two opposite ends of the main body 31 respectively.

Referring particularly to FIG. 4, the base unit 50 defines a pair of latching slots 51, corresponding to the hooks 32 of the latching member 30.

Figure 2:
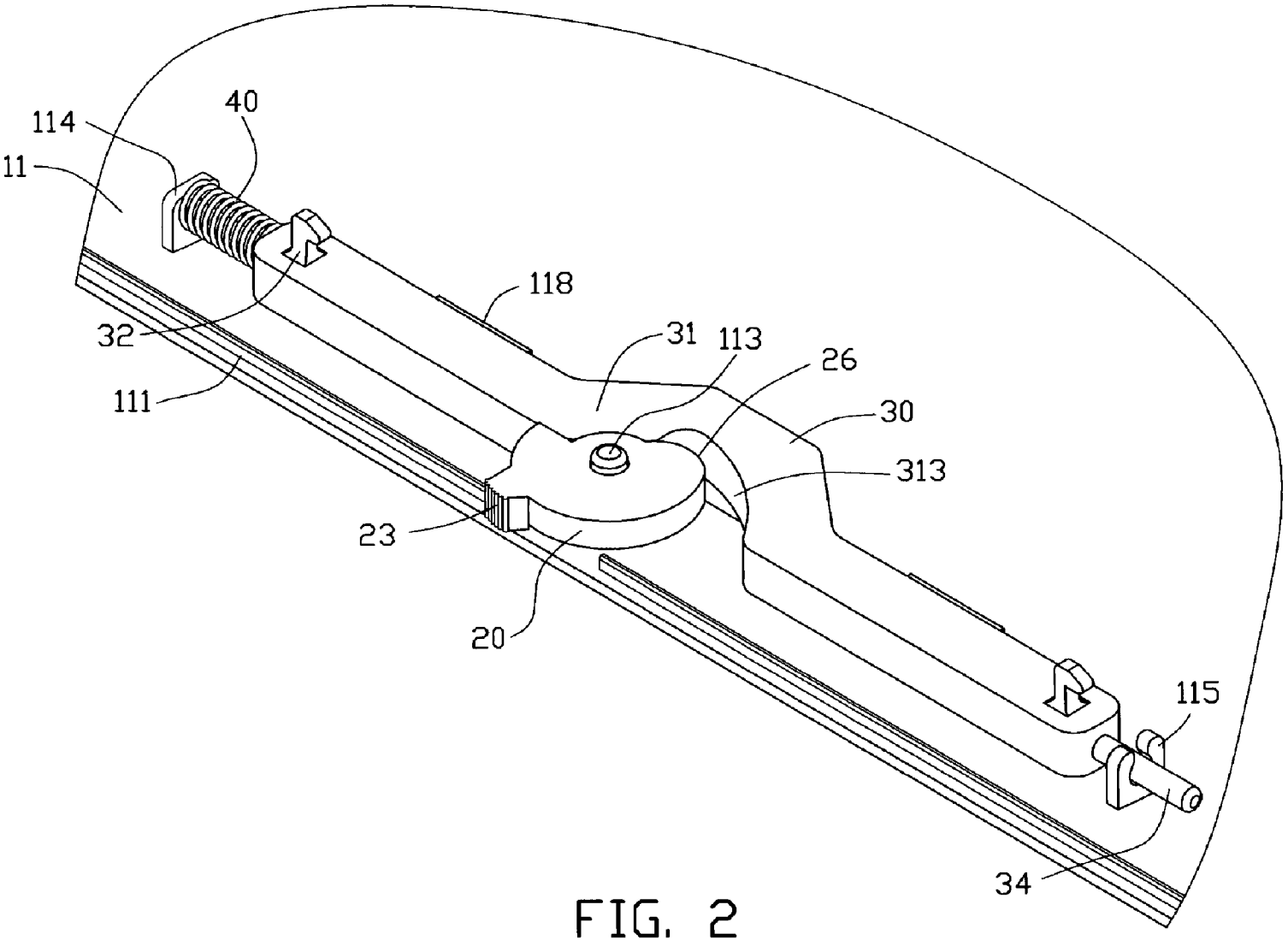
FIG. 2 is an enlarged, assembled view of FIG. 1 without the second panel of the cover unit.

Referring also to FIGS. 1 and 2, in assembly, the elastic member 40 is placed around the first rod 33 of the latching member 30, and a free end of the first rod 33 extends through the first guiding hole 116 of the first plate 114 of the first panel 11, with two free ends of the elastic member 40 respectively engaging with the main body 31 of the latching member 30 and the first plate 114 of the first panel 11. The second rod 34 of the latching member 30 is pressed down into the second guiding hole 117 from the top portion of the second plate 115. Another lateral surface of the main body 31 of the latching member 30 engages with the guiding tabs 118, thereby slidably fixing the latching member 30 to the first panel 11. The button 20 is pivotably mounted on the first panel 11 with the pivot 113 of the first panel 11 extending through the pivot hole 21 of the button 20. The blocking surface 24 of the button 20 abuts against the lateral surface 311 of the main body 31 of the latching member 30, the mating surface 25 of the button 20 is fittingly engaged with the concave section 312 of the main body 31, and the driving surface 26 of the button 20 is received in the recessed section 313 of the main body 31. The knob 23 of the button 20 extends out through one side of the recess 112 of the front wall 111 of the first panel 11, for being manipulated from outside the first panel 11.

The second panel 13 holds a liquid crystal display therein, and the first panel 11 is fixed to the second panel 13 to secure the liquid crystal display. The hooks 32 of the latching member 30 extend outward from the through holes 131 of the second panel 13 respectively; thereby, the cover unit 10 is fully assembled. The cover unit 10 is then pivotably attached to the base unit 50.

In use, the cover unit 10 is pivoted to cover the base unit 50 when the electronic device is not in use. When bottom surfaces of the hooking portions 321 of the hooks 32 abut against portions adjoining the latching slots 51 of the base unit 50 respectively, the cover unit 10 is pressed downward and the latching member 30 is therefore pushed to compress the elastic member 40 and slides toward the first plate 114 until the hooking portions 321 of the hooks 32 entirely enter the latching slots 51 respectively. After that, the elastic member 40 is restored pushing the latching member 30 to slide toward the second plate 115, top surfaces of the hooking portions 321 of the hooks 32 engage with the portions of the base unit 50 adjoining the latching slots 51. Thus, the cover unit 10 is locked to the base unit 50.

Figure 3:
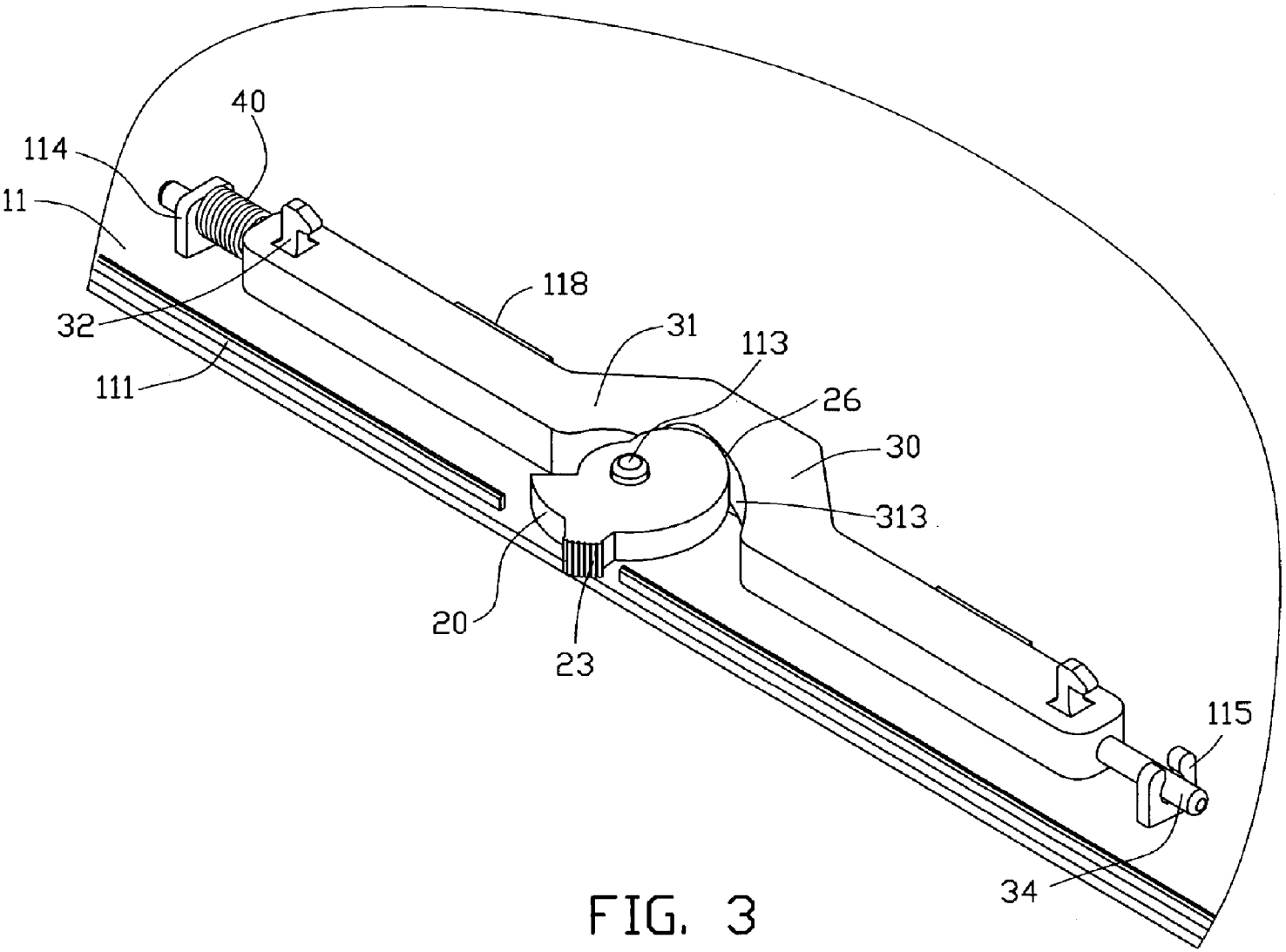
FIG. 3 is similar to FIG. 2, but showing another state of the latch mechanism.

Referring further to FIG. 3, to unlock the cover unit 10 from the base unit 50, the knob 21 of the button 20 is pushed from one side to the other side of the recess 112 to rotate the button 20 around the pivot 113. Concurrently, the blocking surface 24 and the mating surface 25 of the button 20 disengage from the lateral surface 311 and the concave section 312 of the latching member 30 respectively. The driving surface 26 of the button 20 contacts and drives the protruding edge shared by the concave section 312 and the recessed section 313 of the latching member 30, and the latching member 30 is therefore pushed to slide toward the first plate 114 compressing the elastic member 40. The button 20 is continually operated to move the latching member 30 until most of the driving surface 26 of the button 20 engages with the recessed section 313 of the latching member 30, the hooking portions 321 of the hooks 32 move in corresponding latching slots 51 and disengage from the portions adjoining the latching slots 51 respectively, the cover unit 10 is ready to be pivoted open. After the cover unit 10 is opened, the elastic member 40 is restored driving the latching member 30 back, and the latching member 30 drives the button 20 to reversely rotate until the blocking surface 24 of the button 20 abuts against the lateral surface 311 of the latching member 30. The cover unit 10 is then ready to be closed.

It is believed that the present embodiment and its advantages will be understood from the foregoing description, and it will be apparent that various changes may be made thereto without departing from the spirit and scope of the invention or sacrificing all of its material advantages, the example hereinbefore described merely being preferred or exemplary embodiment of the invention.

What is claimed is:

1. A latch mechanism for locking a cover unit to a base unit, the latch mechanism comprising:

a latching member configured for being slidably installed in the cover unit, the latching member comprising a main body and a hook extending from the main body for engaging with the base unit; and a manipulable integrally formed button configured for being rotatably fixed to the cover unit, the button comprising a knob accessible from outside the cover unit for operating the button, and a driving surface operatively engagable with the main body of the latching member for cooperatively transforming rotating movement of the button into linear movement of the latching member thereby disengaging the hook from the base unit;

wherein the main body of the latching member comprises a recessed section, and the driving surface of the button urges against the recessed section to move the latching member, the main body of the latching member further comprises a concave section, the concave section and the recessed section share a protruding edge, the driving surface of the button is arcuate in construction and urges against the protruding edge; the button further comprises an arcuate mating surface adjoining the driving surface and fittingly engagable in the concave section, the mating surface extends a predetermined length around a pivot axis of the button, the driving surface is defined with two ends thereof communicating with the mating surface and a circumferential surface of the button, and an acme of the mating surface is nearer to the pivot axis than an acme of the driving surface to the pivot axis.

2. The latch mechanism as claimed in claim 1, further comprising an elastic member engagable with the latching member for restoring the latching member.

3. A portable electronic device comprising:

a base unit defining at least one latching slot therein;

a cover unit pivotably mounted to the base unit, the cover unit being pivotable between a closed position for covering the base unit, and an opened position for uncovering the base unit;

a latching member slidably mounted to the cover unit, the latching member including a main body and at least one latch portion formed on the main body, the latching member being slidable between a locked position where the latch portion engages in the latching slot in a manner so as to lock the cover unit in the closed position, and an unlocked position where the latch portion disengages from the latching slot allowing the cover unit to be pivoted toward the opened position;

a spring member biasing the latching member toward the locked position; and an integrally formed button pivotably mounted to the cover unit and partially exposed out of the cover unit to be operatively accessible from outside of the cover unit, the button being structured and arranged for engaging with the main body in a manner so as to drive the latching member toward the unlocked position upon pivoting of the buttons;

wherein the main body of the latching member comprises a recessed section, and the button defines a driving surface for urging against the recessed section to move the latching member toward the unlocked position, the button further comprises an arcuate mating surface adjoining the driving surface and fittingly engagable in a concave section of the main body, the mating surface extends a predetermined length around a pivot axis of the button, the driving and a surface is defined with two ends thereof communicating with the mating surface and a circumferential surface of the button, and an acme of the mating surface is nearer to the pivot axis than an acme of the driving surface tote pivot axis.

4. The portable electronic device of claim 3, wherein a sliding axis of the latching member is parallel to the cover unit, and a pivoting axis of the button is perpendicular to the cover unit.

* * * * *